United States Patent [19]

Terada et al.

[11] 4,037,869

[45] July 26, 1977

[54] CLAMPING DEVICE FOR USE IN LIFTING SHIP'S HULL BLOCKS OR THE LIKE

[75] Inventors: Yoshimi Terada, Himeji; Akira Fujii, Aioi, both of Japan

[73] Assignee: Ishikawajima-Harima Jukogyo Kubushiki Kaisha, Ote, Japan

[21] Appl. No.: 652,739

[22] Filed: Jan. 27, 1976

[30] Foreign Application Priority Data

June 24, 1975 Japan ..... 50-87956[U]

[51] Int. Cl.[2] ..... B66C 1/10

[52] U.S. Cl. ..... 294/104; 114/65 R

[58] Field of Search ..... 114/65 R; 294/104; 269/237, 238, 228

[56] References Cited

U.S. PATENT DOCUMENTS 3,167,343 1/1965 Renfroe ..... 294/104 X

*Primary Examiner*—Trygve M. Blix
*Assistant Examiner*—Sherman D. Basinger
*Attorney, Agent, or Firm*—Scrivener, Parker, Scrivener and Clarke

[57] ABSTRACT

A support is forced to be extended between a longitudinal member of a hull block clamped between a movable jaw and a fixed jaw on the one hand and another longitudinal member located adjacent to the first mentioned longitudinal member so that the load exerted to the clamping device when the hull block is lifted as well as the reaction force exerted to the support may force the movable jaw against the longitudinal member to firmly clamp it between the movable and fixed jaws. The longitudinal member is so firmly clamped between the movable and fixed jaws that it is not released even when the hull block is lifted in the vertical position.

1 Claim, 12 Drawing Figures

Fig. 6
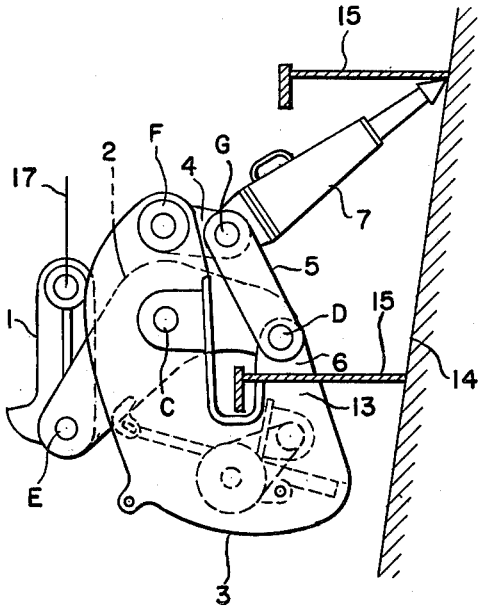
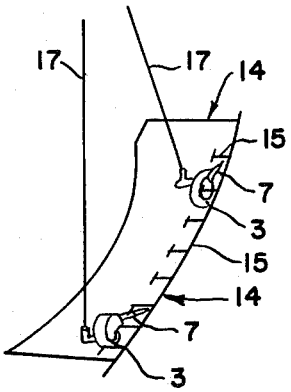
Fig. 7
Fig. 8
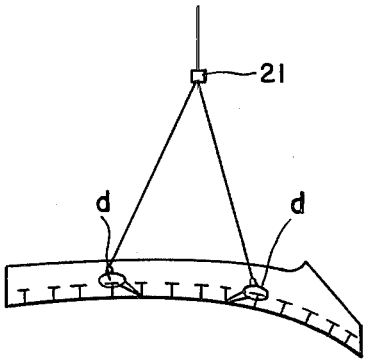
Fig. 9
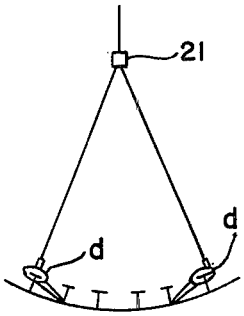
Fig. 10
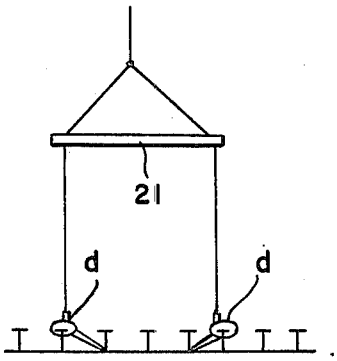

CLAMPING DEVICE FOR USE IN LIFTING SHIP'S HULL BLOCKS OR THE LIKE

DETAILED DESCRIPTION OF THE INVENTION

The present invention relates to a clamping device especially adapted for use in lifting ship's hull blocks or the like.

In the conventional method for lifting and moving or mounting a curved hull side plating block, a plurality (in general, two or four) of suspension devices *b* such as eyes are attached by welding to a block a as shown in FIG. 1, and after the block *a* has been placed in the desired location, the suspension devices *b* are cut off by gas cutting from the block a. Therefore the conventional method has the following problems:

i. Before the hull block *a* is lifted and moved to the desired location, a large number of preparatory steps must be accomplished. That is, the suspension devices *b* with suitable dimensions must be selected; the center of gravity of block *a* must be obtained; the suitable positions for attaching the suspension devices *b* to the block must be calculated; the suspension devices *b* must be joined to the block a by welding; the inspection of the welded joints must be carried out; and so on.

ii. After the hull block has been moved to the desired location, the suspension devices must be cut off from the block by gas cutting or the like; the cutout portions must be ground and coated again with paint, and so on. Such operations as described above are very dangerous so that satisfactory safety measures must be provided.

In view of the above, one of the objects of the present invention is to provide a clamping device for use in lifting hull blocks which may eliminate the dangerous operations which must be carried out at the working positions high above the ground after the hull block has been erected on the ship berth or the assembled hull structure.

Another object of the present invention is to provide a clamping device which may attain the highly efficient automatic lifting of hull blocks or the like.

The above and other objects of the present invention may be attained by a clamping device for use in lifting ship's hull blocks or the like characterized in that a clamping lever with a movable jaw pivoted at one end thereof is pivoted to a frame having one end thereof terminated in a fixed jaw in such a way that a longitudinal member of the hull block may be inserted and clamped between said movable and fixed jaws, and a support is connected through a linkage to said frame and said clamping lever so as to be forcibly extendable between said linkage and another longitudinal member of the block located adjacent to said first mentioned longitudinal member, whereby said movable and fixed jaws may firmly clamp said first mentioned longitudinal member therebetween by utilizing the load exerted to the clamping device when the block is lifted and the reaction force produced in said support by said load in such a way that even when the block is lifted in the vertical position said movable and fixed jaws may not release said first mentioned longitudinal member.

In the accompanying drawing.

Figure 1:
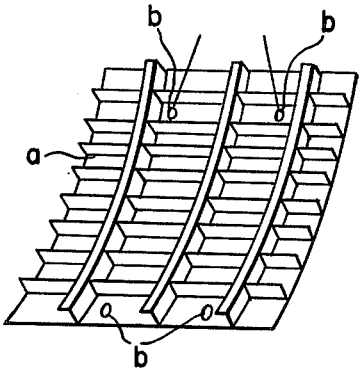
Fig. 1 PRIOR ART
FIG. 1 is a view used for the explanation of the conventional method for lifting a ship's hull block.
Figure 2:
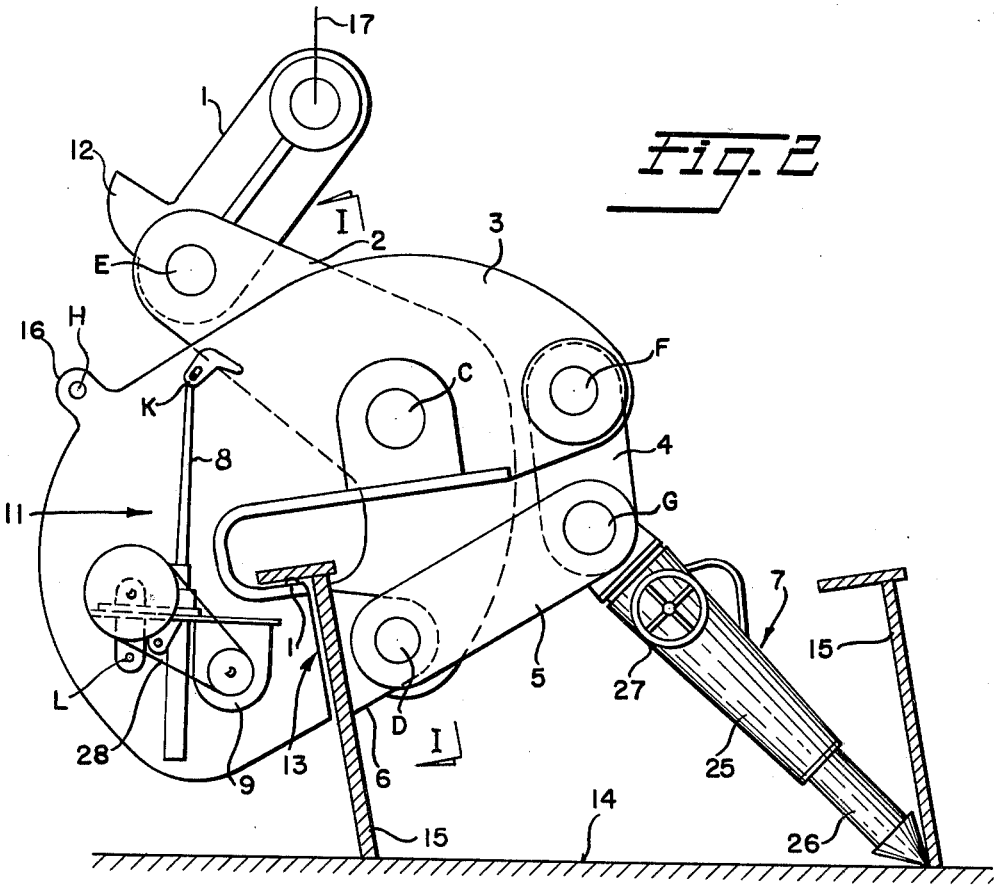
FIG. 2 is a side view of a clamping device in accordance with the present invention.
Figure 2A:
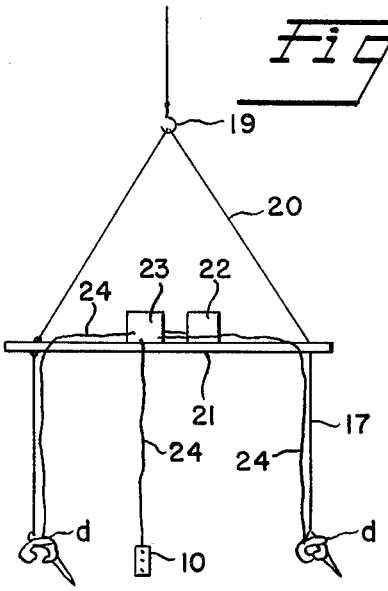
Figure 4:
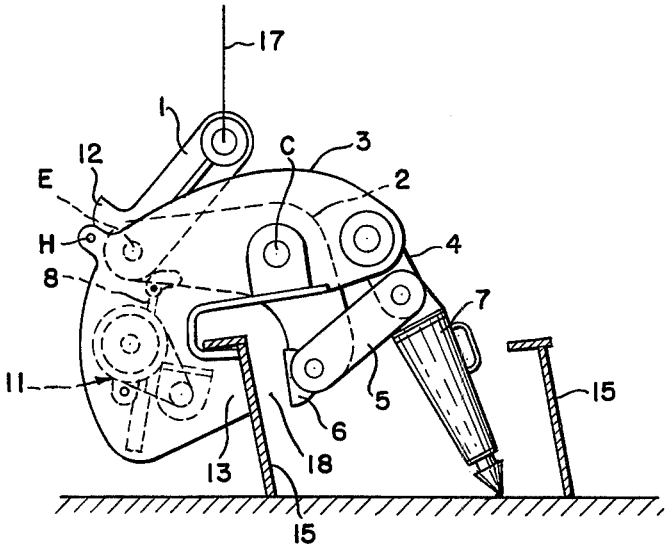
Figure 2B:
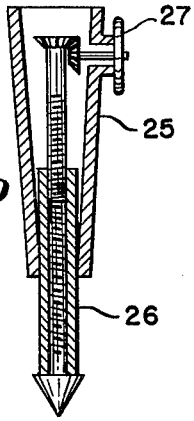
Figure 3:
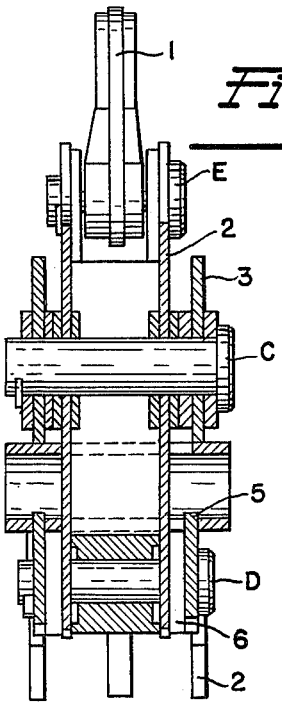
Figure 5:
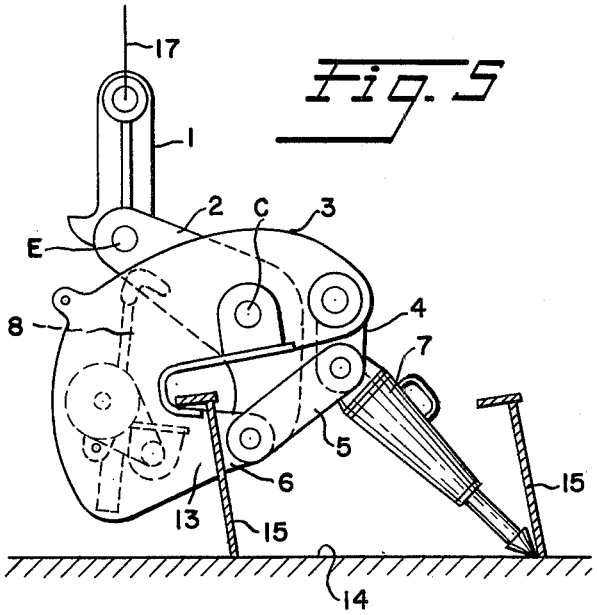

FIG. 2*a* is a view used for the explanation of the method for lifting a hull block by a crane with the clamping devices in accordance with the present invention;

FIG. 2*b* is a sectional view of a support 7 shown in FIG. 2;

FIG. 3 is a sectional view taken along the line I — I of FIG. 2;

FIG. 4 shows the clamping device ready to be set to the hull block;

FIG. 5 shows the clamping device set to the hull block;

FIG. 6 shows the hull block being lifted in the vertical position with the clamping device; and FIGS. 7, 8, 9 and 10 show hull blocks being lifted with the clamping devices in accordance with the present invention.

One preferred embodiment of a clamping device in accordance with the present invention will be described with reference to FIGS. 2–10. First referring to FIG. 2*a*, a horizontal beam 21 in the form of a bar or any other suitable construction is suspended by a wire 20 from a crane hook 19, and clamping devices *d* in accordance with the present invention are suspended with wire ropes 17 from both ends of the horizontal beam 21. An electric power source or storage battery 22 is mounted on the horizontal beam 21 and electrically connected to the clamping devices *d* through cables 24 to the clamping devices *d* and a control unit 23 mounted on the horizontal beam 21 and electrically connected to a pendant 10 through the cable 24 so that an operator on the ground or at any other suitable position may operate the pendant 10 for controlling the operation of the clamping devices *d*.

Next referring to FIGS. 2 and 3, the clamping device in accordance with the present invention is so arranged as to clamp a ship's hull block by utilizing both the load of the hull block lifted and its reaction force. The clamping device comprises a hook-shaped frame 3 with one end terminated into a first or fixed jaw 13 and with a projection 16 through which is extended a pin H, and a clamping lever 2 in the form of a rocker pivoted at the midpoint with a pin C to the frame 3. One or upper end of the clamping lever 2 is pivoted with a pin E to one end of a suspension lever 1 with a pawl 12 and the hoisting rope 17 is securely made fast to the other end thereof. A second or movable or jaw 6 is pivoted with a pin D to the other or lower end of the clamping lever 2 so as to coact with the first or fixed jaw 13 for clamping a longitudinal member 15 of the hull block therebetween as will be described in detail hereinafter. A worm jack assembly generally indicated by the reference numeral 11 includes a ram or screw 8 and a motor 9 drivingly coupled through a pulley drive 28 to a worm wheel in mesh with a worm of the ram 8. The upper end of the ram 8 is pivoted with a pin K to the clamping lever 2. The motor 9 of the worm jack assembly 11 is operatively connected to the control until 23 and hence to the pendant 10 so that the operation of the worm jack assembly 11 may be controlled by the operator on the ground.

One end of a first link 5 is pivoted with the pin D to the lower end of the clamping lever 2, and one end of a second link 4 is pivoted with a pin F to the frame 3 at the end remote from the fixed jaw 13. The other ends of the first and second links 5 and 4 are pivoted with a common pin G to a support 7 which causes the second or movable jaw 6 to force against the first or fixed jaw 13 of the frame 3 under the reaction force exerted to the support 7 when the hull block is lifted. Therefore the longitudinal member 15 may be more firmly clamped between the first and second jaws 13 and 6.

As shown in FIG. 2*b*, the support 7 used in this embodiment is of the screw jack type comprising a main body 25 and a ram 26 operatively coupled through a screw and a pair of bevel gears to an operating handle 27 so that the ram 26 may be extended out of or retracted into the main body when the operator rotates the handle 27. The ram 26 has the dimensions sufficient to withstand the reaction force exerted thereto when the hull block is lifted. Instead of the screw jack type support 7, a motor driven or hydraulic support may be used. In case of the hydraulic support, a hydraulic control unit is mounted on the horizontal beam 21 (See FIG. 2*a*) and operatively coupled to the hydraulic support.

In like manner, instead of the motor driven worm jack assembly 11, a hydraulic jack assembly may be used.

Next the general mode of operation of the clamping device with the above construction will be described. To the lift the hull block, the ram 8 is retracted to move the movable jaw 6 away from the fixed jaw 13 so that the longtidunal member 15 of the hull block 14 may be inserted between them. The ram 26 of the support 7 is extended until the base or lower end of the ram 26 engages with the root of the longitudinal member 15 located adjacent to the member 15 to be clamped by the movable and fixed jaws 6 and 15. Thereafter the wire rope 17 is hoisted. Then the load and the reaction force exerted to the support 7 (by the load) exert on the movable jaw 6 so that the longitudinal member 15 may be firmly clamped between the movable and fixed jaws 6 and 13. To release the member 15, the wire rope 17 is slacked and the ram 26 of the support 7 is retracted. Then the fixed and movable jaws 13 and 6 are moved away from each other to release the longitudinal member 15.

Next referring to FIGS. 4, 5 and 6, the mode of operation will be described in more detail. Even though two clamping devices d are suspended from the horizontal beam 21 (See FIG. 2*a*), the operation is substantially similar in both devices so that only one will be taken as an example. The clamping device is lifted and moved above the desired longitudinal member 15 by a crane (not shown). Operating on the pendant 10, the operator starts the motor 9 of the worm jack assembly 11 to retract the ram 8. As a result, the clamping lever 2 is caused to rotate about the pin C in the counterclockwise direction so that the movable jaw 6 at the lower end of the clamping lever 2 is moved away from the fixed jaw 13 of the frame 3 as indicated by 18 in FIG. 4. As the clamping lever 2 is rotated, the pawl 12 of the lifting link 1 engages with the pin H at the projection 16 of the frame 3 so that the lifting link 1 is rotated in the clockwise direction toward the frame 3. Therefore, the upper end (that is, the joint between the wire rope 17 and the lifting link 1) of the link 1 is located on the vertical line passing through the center of gravity of the clamping device so that the latter may be easily operated on the hull block 14 laid horizontally. Thereafter the clamping device is lowered so that the longitudinal member 15 may be inserted into the space 18 between the movable and fixed jaws 6 and 13 as shown in FIG. 4 and the fixed jaw 13 is pressed against the longitudinal member 15.

Next the support 7 is extended until the base of the ram 26 engages with the root of the adjacent longitudinal member 15, and the motor 9 is driven in the opposite direction to extend the ram 8 of the worm jack assembly 11. The clamping lever 2 is rotated about the pin C in the clockwise direction so that the movable jaw 6 at the lower end of the clamping lever 2 is pressed against the longitudinal member 15. The support 7 is operated again so as to further extend the ram 26 thereby exerting the force through the first link 5 to the movable jaw 6. Thus the setting operation is accomplished.

When the wire rope 17 is hoisted under the above conditions, the clamping lever 2 is caused to rotate about the pin C in the clockwise direction so that the movable jaw 6 is further forced against the longitudinal member 15. Thus the clamping device completely clamps the longitudinal member 14 and hence the hull block 14 as shown in FIG. 5.

Next the length of the wire ropes 17 suspending the clamping devices d is adjusted so that the hull block 14 may be lifted as shown in FIGS. 6 and 7. However, it should be noted that the hull block 14 may be lifted in the horizontal position as shown in FIGS. 8, 9, and 10. In the horizontal position, the pin E of the clamping lever 2 is located at the left and upwardly of the movable jaw 6 as shown in FIG. 5. Therefore, when the hull block 14 is lifted from the horizontal position to the vertical position as shown in FIG. 6, the rotation moment in the clockwise direction is produced in the frame 3 and exerted to the support 7. As a result, the reaction force is produced in the support 7. This reaction force is resolved into the components acting in the directions of the axes of the first and second links 5 and 4. The component acting on the second link 4 is encountered by the rotation moment of the frame 3 so that no bending moment is exerted to the longitudinal member 15. Consequently the longitudinal member 15 may be clamped in a stabilized manner. The component acting on the first link 5 acts on the pin D so that the movable jaw 6 is forced against the longitudinal member 15. Thus the hull block may be securely clamped. In addition to the clamping forces, the inner hooked portion I of the frame 3 is made into engagement with the face of the longitudinal member 15 so that the secure and safe lifting of the block 14 may be ensured.

After the hull block 14 is lifted and moved to the desired position, the wire rope 17 is slacked and the ram 8 of the worm jack assembly 11 is retracted. The movable jaw 6 is moved away from the longitudinal member 15 so that the clamping device may be easily released from the hull block 14.

It is to be understood that the clamping devices in accordance with the present invention are not limited in their use only to the blocks of the curved hull side plating. They may be used for lifting and moving various types of hull blocks such as curved blocks shown in FIGS. 8 and 9 and the flat block shown in FIG. 10.

In order to make the fine adjustment of the lifting angle of the block, chain blocks or the like may be interposed between the clamping devices and another beam suspended from the horizontal beam.

The clamping device in accordance with the present invention may attain various excellent effects and advantages. For instance, the steps for attaching, and removing the conventional lifting devices as well as the step for assemblying a scaffolding for the lifting device attachment and removal steps may be eliminated. Therefore, the number of hull assemblying steps may be reduced, and the shipbuilding efficiency may be much improved. Furthermore, the damage to the hull blocks during lifting may be eliminated so that the quality of the hull blocks may be ensured. Moreover, the clamping devices may be remote controlled so that the steps for attachment and removal of the conventional lifting devices at the working positions high above the ground may be eliminated and consequently the safe operation may be ensured.

What is claimed is:

1. A clamping device for use in lifting ship's hull blocks of the type having spaced-apart longitudinal members comprising a frame, a clamping lever pivotally mounted on the frame, a movable jaw pivoted to one end of said lever, said frame being provided with a fixed jaw arranged in opposed relationship to said movable jaw, said lever being pivotally movable to clamp a longitudinal member between the movable and fixed jaws, a first link having one and pivoted to said one end of the lever, a second link having one end pivoted to said frame, a pivotal connection between the other ends of the first and second links, an elongated support having one end pivotally connected with said other ends of the first and second links at the last named pivotal connection, and means for extending said support to bring the other end thereof in firm engagement with an adjacent longitudinal member whereby the movable and fixed jaws firmly clamp the longitudinal member therebetween under the load force exerted to the clamping lever when a hull block is lifted and by the reaction force exerted to the movable jaw through said support.

* * * * *